United States Patent [19]

Maillet

[11] Patent Number: 4,632,035

[45] Date of Patent: Dec. 30, 1986

[54] ARMING METHOD AND DEVICES FOR FIRING A SUBMARINE WEAPON

[75] Inventor: Fernand M. Maillet, Saint-Tropez, France

[73] Assignee: Etat Francais represente par le Delegue General pour l'Armement, Paris Armees, France

[21] Appl. No.: 678,402

[22] Filed: Dec. 5, 1984

[30] Foreign Application Priority Data

Dec. 27, 1983 [FR] France ..... 83 20815

[51] Int. Cl.[4] ..... F42C 15/10; F42C 15/32

[52] U.S. Cl. ..... 102/420; 102/223; 102/263

[58] Field of Search ..... 102/420, 416, 406, 221, 102/223, 263; 200/61.04, 209, 210

[56] References Cited

U.S. PATENT DOCUMENTS 2,551,608 5/1951 Kissinger ..... 102/420

2,795,189 6/1957 Haberland ..... 102/420

3,195,460 7/1965 Kalaf ..... 102/420

*Primary Examiner*—Charles T. Jordan

*Attorney, Agent, or Firm*—Parkhurst & Oliff

[57] ABSTRACT

The present invention relates to arming methods and devices for firing a submarine weapon.

A device according to the present invention comprises a piston connected by a strip to a bistable arming organ. The piston shifts inside a cylindrical body between a first and second chamber. The first chamber accommodates sea water through orifices. The second chamber accommodates sea water through a valve and a cavity which is filled with sodium chloride. The piston is hollow and contains a semi-permeable fitting which is in contact with sea water that is contained inside the first chamber through a bore and ducts, and with the salt saturated solution contained inside the second chamber through channels.

7 Claims, 2 Drawing Figures

ARMING METHOD AND DEVICES FOR FIRING A SUBMARINE WEAPON

BACKGROUND OF THE INVENTION

The present invention pertains to arming methods and devices for firing a submarine weapon.

Submarine weapons which carry explosive loads include a safety and arming device that fulfills three functions. First, it activates an arming organ to shift from an unarmed position in which the explosive load cannot be fired to an armed position in which the explosive load can be fired. Second, it delays the arming command in order to allow the weapon launcher to withdraw sufficiently before the weapon is armed. Third, it provides safety to the device by prohibiting arming unless specific conditions are met which are related to the nature of the outside environment.

A safety and arming device includes a bistable organ which is the arming organ itself. The bistable organ can be disposed in two positions: an initial unarmed position where it prevents firing and a second armed position where it allows firing. The bistable organ for instance can be a switch inserted in the electric firing circuit and/or a tilting shutter which prevents or allows the sending of the command to fire.

A safety and arming device also includes an activator which controls the movement of the bistable arming organ and consumes energy.

The present invention pertains to arming methods and devices which include new activating means for a bistable organ.

In known arming devices, the activator is usually an electromechanical organ such as a gear motor or an electro-magnet which must be supplied with electric energy. The activator may also be an hydraulic organ such as a jack which uses hydrostatic pressure as a source of energy.

The delay of the tilt of the bistable organ can result from the nature of the activator itself, for example in the case of a gear motor from the time needed for the output shaft of the activator to perform a number of rotations. In other cases, the tilt of the bistable organ must be executed by a distinct delay organ. The safety prevents arming by using the properties of the environment external to the weapon after launching, or the properties of sea water in the case of a submarine weapon, such as hydrostatic pressure or electrical conductivity.

SUMMARY OF THE INVENTION

The purpose of the present invention is to provide new activating means for the bistable organ which is part of an arming device for firing an explosive load carried by a submarine weapon or structure. The new activating means of the present invention do not require a source of energy aboard the submarine structure and they make it possible to fulfill the three activating, delay and safety functions with a single device.

The methods and devices according to the present invention utilize the osmosis phenomenon. The osmosis phenomenon is the transfer of solvent through a semi-permeable membrane of a less concentrated solution towards a more concentrated solution, which gives rise to differential pressure if one of the solutions is placed in a closed volume. In the case of a submarine weapon, the osmosis phenomenon is concerned with sea water.

The objects of the present invention are attained with a method by which a bistable arming organ is activated by exerting a differential pressure on a piston. The differential pressure exerted is the osmotic pressure developed between sea water and a sodium chloride solution having a salt concentration different from that of sea water. Advantageously the piston is moved inside a cylindrical body which includes two chambers that are separated by the piston, sea water is admitted to one of the chambers and the other chamber is a closed volume that is filled with an aqueous sodium chloride solution having a salt concentration different from that of sea water. Preferably, sea water and the salt solution contained respectively in each of the two chambers are brought into contact with a semi-permeable membrane that is incorporated inside the piston.

A safety and arming device according to the present invention for firing an explosive load borne by a submarine weapon, includes a piston which is connected by a strip to a bistable arming organ, the piston moves inside a cylindrical body and divides it into a first chamber which communicates openly with the sea and a second chamber which is a closed volume that contains a sodium chloride solution having a salt concentration different from that of sea water. The piston is hollow and contains a semi-permeable fitting. The device includes means to bring the salt solutions contained in both chambers into contact with two opposing sides of the semi-permeable fitting.

According to a first embodiment, the second chamber communicates with the sea through a calibrated nonreturn valve and through a cavity which is filled with sodium chloride, so that water which penetrates to the second chamber is saturated with salt.

According to a second embodiment, the second chamber is a closed volume which is filled with fresh water.

The invention results in new arming and safety means for the firing of an explosive load borne by a submarine structure or weapon.

The use of pressure generated by the transfer of water through an osmotic membrane makes it possible to move the piston without resorting to another source of energy aboard the submarine structure, and hence provides total safety during the storage and conveyance of weapons. Furthermore, the submarine weapons according to the present invention are ready for use, even after extended storage, without a need for verifying a source of energy or outfitting them at the last minute with a source of energy. Since sea water is one of the solutions which is involved in the osmosis phenomenon, a weapon outfitted with an arming device according to the present invention displays total safety prior to launching while it is not in contact with the sea.

Moreover, osmotic pressure increases slowly according to the flow of solvent through the membrane, which makes it possible to obtain a delay between the moment of launching and arming.

Therefore, the activating device of a bistable arming organ according to the present invention makes it possible to achieve the three activating, delay and safety functions with a single device whose mechanical implementation is fairly simple and which is sturdy and highly reliable device.

In the event of a failure of the osmotic fitting, such as becoming permeable in both directions, differential pressure is not generated and therefore the piston remains in a resting position which corresponds to the unarmed state. Therefore, safety is maintained.

Beyond the minimal pressure needed to activate the sea water input valve in the embodiment which includes such a valve, the operation of the device according to the present invention is independent of the hydrostatic pressure and therefore of the submersion depth of the submarine.

BRIEF DESCRIPTION OF THE DRAWINGS

The following description refers to the attached drawings which represent, without any restrictive features, two embodiments of a device according to the present invention.

DETAILED DESCRIPTION OF THE INVENTION

Figure 1:
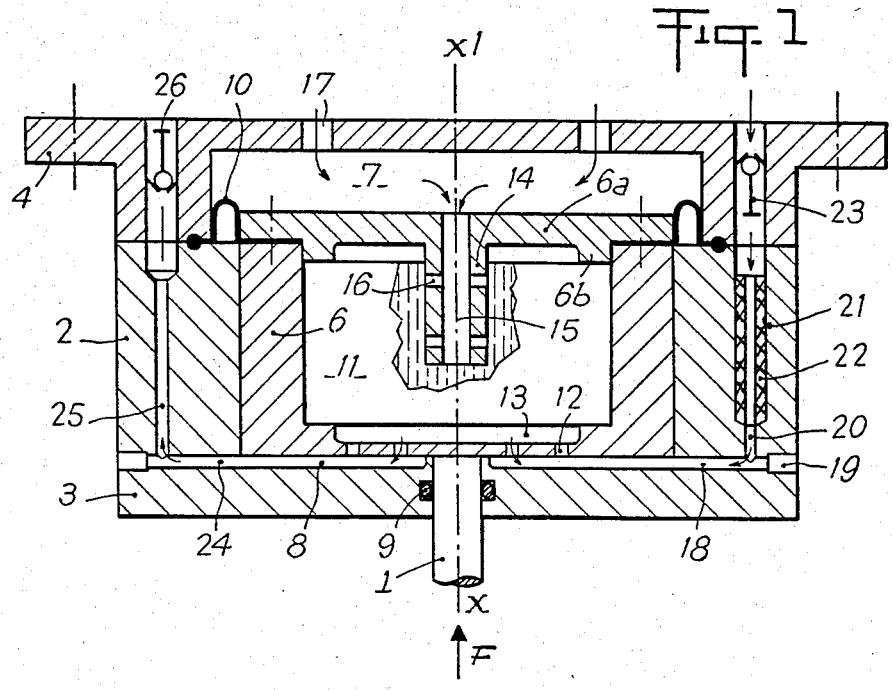
FIG. 1 is an axial section of a first embodiment of the present invention.
Figure 2:
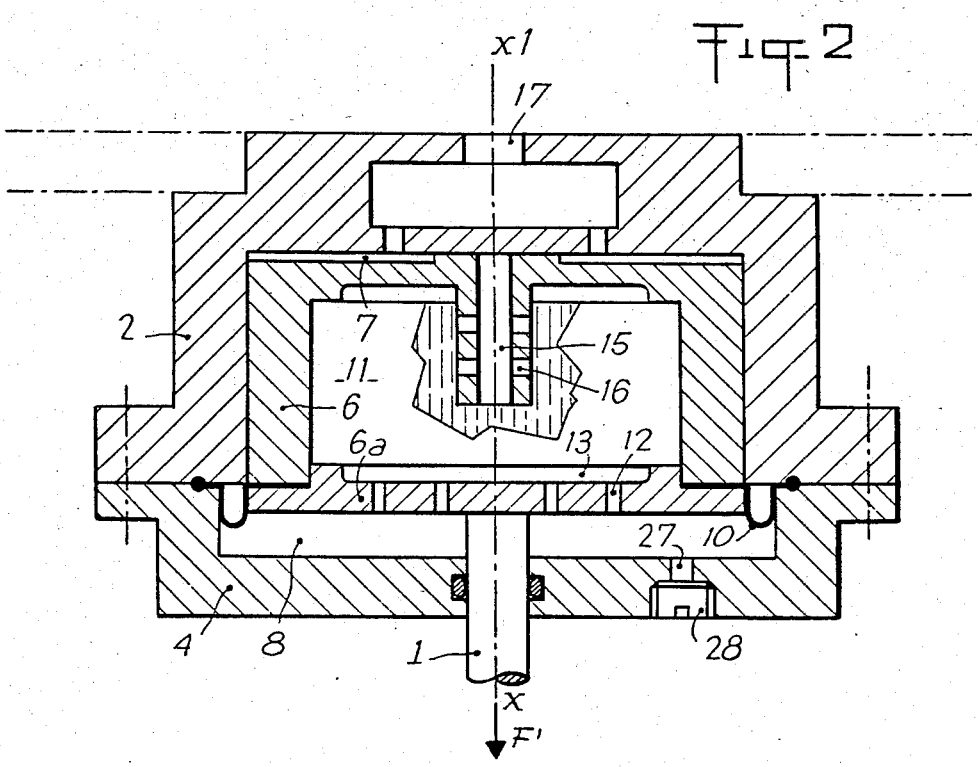
FIG. 2 is an axial section of a second embodiment of the present invention.

The firing device for an explosive load usually includes an arming and safety device which is comprised of a bistable organ, such as a switch or a mechanical part such as a shutter which must tilt from an initial position to a second armed position in order to allow firing of the explosive load. The safety and arming device also includes an activator, which is set in motion by a source of energy, that controls the tilt of the bistable organ. FIGS. 1 and 2 depict only the activator. The bistable arming organ which is of any known type is not shown in the drawings. The bistable arming organ is mechanically connected to the device according to the present invention by a strip 1. A movement of strip 1 in the direction of arrow F controls the arming of the bistable organ.

The device according to FIG. 1 is mounted on a submarine weapon and therefore it is submerged when the weapon touches the water.

The device according to FIG. 1 includes a hollow cylindrical body 2 having an axis x,xl and having a first end closed by a bottom 3. The second end of the cylinder is closed by a cover 4 which is affixed by any sealing means onto the hollow body 2. The hollow body 2, the bottom 3 and the cover 4 define a cylindrical cavity 5 having an axis x,xl. Disposed inside the cavity is a movable piston 6 which separates a first chamber 7 and a second chamber 8. The strip 1 is affixed to the piston 6 and crosses the bottom 3 through a sealing fitting 9. The strip 1 transmits the axial shift of the piston 6 to the firing organ.

A flexible and malleable membrane 10 is inserted between the piston 6 and the cylindrical body 2. The membrane 10 and the piston 6 constitute a sealed separation between the first chamber 7 and the second chamber 8.

FIG. 1 depicts an embodiment in which the membrane 10 is ring-like and the outer edge is pinched between the cover 4 and the cylindrical body 2. In this embodiment, the piston 6 includes a disk 6*a* which is affixed coaxially against one end of the piston 6, and the inner edge of the membrane 10 is pinched between the disk 6*a* and the piston 6. The disk 6*a* includes a peripheral shoulder 6*b* which is lodged inside the piston 6 in order to center the disk 6*a* in relation to the piston 6.

Of course, it is possible to construct a device according to FIG. 1 by using other embodiments equivalent to the membrane 10 and the affixing thereof.

The piston 6 is a hollow piston, so that the piston and the disk 6*a* define a cavity inside the piston. The cavity is filled with a semi-permeable fitting 11 that is composed of hollow fibers which enables the osmotic transfer of a solvent to a more concentrated solution when the fitting is placed between two solutions with different concentrations.

The second chamber 8 communicates through orifices 12 with a chamber 13 that is defined by the fitting 11 and by the bottom of the piston 6, so that the liquid which is inside the chamber 8 comes into contact with the lower side of the fitting 11. The fitting 11 includes a central well inside which is an axial cylindrical body 14 which extends from the disk 6*a*. The cylindrical body 14 is pierced with an axial bore 15 that leads inside chamber 7, and radial orifices 16 which come into contact with the fitting 11, so that the liquid which is in chamber 7 penetrates the axial bore 15 and comes into contat with the fitting 11.

The cover 4 includes a plurality of orifices 17 to allow sea water to enter freely into the first chamber 7 through orifices 17 and come into contact with the osmotic fitting 11 when the device is submerged along with the submarine weapon or structure on which it is mounted.

FIG. 1 shows an embodiment in which use is made of a difference in pressure between sea water that is inside the first chamber 7 when the device is submerged, and an aqueous solution which has a higher salt concentration than sea water which is inside the second chamber 8. Due to the difference in pressure, sea water from chamber 7 crosses the fitting 11 by osmosis and triggers a pressure increase inside chamber 8, which is a closed volume, which forces the piston 6 in the direction of arrow F to arm the firing device.

The second chamber 8 communicates with a pierced duct 18 through the cylindrical body 2 of which the outer end is closed by a cork 19.

The duct 18 communicates through another duct 20 with a cavity 21 which contains sodium chloride crystals 22. The cavity 21 communicates with the ambient environment through a calibrated nonreturn valve 23 which allows sea water into the cavity and prevents it from escaping when the pressure rises inside chamber 8. Chamber 8 also communicates with the ambient environment through ducts 24, 25, which are bored into the walls of the hollow body 2, and through a calibrated safety valve 26. The calibrated safety valve 26 is calibrated to open when pressure inside the chamber 8 reaches a maximum level that exceeds the pressure required to shift the piston 6 in order to limit the pressure build-up inside chamber 8.

The operation of the device is as follows.

The device according to FIG. 1 is mounted onto a submarine structure which contains an explosive load. As long as the structure is not in water, especially during storage periods or prior to launching in water, the first chamber 7 and the second chamber 8 are empty, and no differential pressure is exerted on the piston 6. Accordingly, the firing organ cannot be armed. Therefore, the device satisfies an initial safety function since it prevents arming of the firing organ when the submarine structure on which it is mounted is not in contact with water.

When the structure is in contact with water, for instance through a launching barrel or any other equivalent launching device, sea water enters directly into the first chamber 7 through orifices 17. It also enters into the second chamber 8 through the valve 23 and the cavity 22 where it is saturated with salt, so that chamber 8 is filled with a saturated salt solution. At the beginning, the pressure levels are equal inside the first chamber 7 and the second chamber 8.

As a result of the salt concentration difference, water gradually crosses from chamber 7, which contains the less concentrated solution, to chamber 8 by osmotic diffusion through the semi-permeable fitting 11.

Pressure gradually rises inside chamber 8 and it sets up a difference in pressure between the two sides of the piston 6 which pushes the piston in the direction of arrow F.

The rise in pressure takes a certain period of time and the device according to the present invention therefore satisfies a delay function between the moment the structure is launched into the water and the time the device generates arming, thus making it possible for the launcher to withdraw sufficiently before the firing mechanism of the explosive load is armed.

When the piston 6 shifts under the effect of the difference in pressure, the shift is transmitted mechanically to the arming organ by the strip 1 and it activates the arming organ by making it tilt from an unarmed position to an armed position.

FIG. 2 depicts an embodiment of a device according to the present invention which utilizes the passage by osmosis of water from sea water to fresh water, or from a solution having a sodium chloride concentration than that of sea water.

Corresponding elements are indicated by the identical reference numerals in FIGS. 1 and 2.

In the second embodiment, the second chamber 8 is defined by the disk 6*a* and by the cover 4 of the cylindrical body 6. The strip 1 of the piston crosses the cover 4. Chamber 8 is a closed chamber which is filled with fresh water through an orifice 27 that is closed with a threaded cork 28.

The first chamber 7 communicates through orifices 17 with the ambient environment and it communicates through the bore 15 and the radial ducts 16 with the axial well that is bored into the semi-permeable fitting 11. Chamber 8 communicates through orifices 12 with the chamber 13 that is defined by the lower side of the fitting 11 and by the disk 6*a*.

When the structure is launched into water, sea water penetrates chamber 7 and from there, through bore 15 and ducts 16, until it comes into contact with the fitting 11.

The imbalance in salt concentration generates a fresh water transfer by osmosis from chamber 8 to chamber 7 through the fitting 11. The pressure in chamber 8 drops and, under the effect of the difference in pressure between the hydrostatic pressure which prevails in chamber 7 and the decreasing pressure in chamber 8, the piston 6 moves to chamber 8 and its shift in the direction of arrow F′ is transmitted to the firing organ.

It is noticed that at the time of launching, regardless of the submersion depth, the piston 6 cannot move as long as part of the water contained inside chamber 8, which is a closed volume, is not able to escape out of it by osmosis through the fitting 11.

While the present invention has been described in detail and with reference to specific embodiments thereof, it will be apparent to one skilled in the art that various changes and modifications can be made therein without departing from the spirit and scope thereof.

What is claimed is:

1. A method for firing of an explosive load borne by a submarine weapon, comprising: exerting a differential pressure on a piston to shift said piston inside a cylindrical body to activate a bistable arming organ, wherein said cylindrical body is separated into a first chamber and a second chamber by said piston and wherein said first chamber is filled with sea water and said second chamber is filled with an aqueous sodium chloride solution having a different salt concentration than said sea water, whereby said differential pressure is created by osmotic pressure between said sea water and said aqueous sodium chloride solution.

2. The method of claim 1, wherein said sea water contained in said first chamber and said salt solution contained in said second chamber, are brought into contact with opposing sides of a semi-permeable membrane incorporated in said piston.

3. A safety and arming device for firing an explosive load borne by a submarine weapon, comprising: a piston mechanically connected by a strip to a bistable arming organ, said piston moving inside a cylindrical body and separating said cylindrical body into a first chamber and a second chamber, said first chamber communicating with and containing sea water and said second chamber defining a closed volume containing a sodium chloride solution having a different salt concentration than said sea water, said piston being hollow and containing a semi-permeable fitting, and, means to bring a solution contained in said first and second chamber into contact with opposing sides of said semi-permeable fitting.

4. The device of claim 3, wherein said second chamber communicates with sea water through a calibrated nonreturn valve and through a cavity filled with sodium chloride, whereby sea water entering said second chamber is saturated with sodium chloride.

5. The device of claim 4, wherein said second chamber also communicates with sea water through a calibrated safety valve.

6. The device of claim 3, wherein said semi-permeable fitting comprises a cylindrical block of hollow fibers having an axial well, wherein a cylindrical body having an axial bore and radial channels is disposed in said axial well and said axial bore communicates with said first chamber.

7. A safety and arming device for firing an explosive load borne by a submarine weapon, comprising:

a piston mechanically connected by a strip to a bistable arming organ, said piston moving inside a cylindrical body and separating said cylindrical body into a first chamber and a second chamber, said first chamber communicating with and containing sea water and said second chamber defining a closed volume containing fresh water, said piston being hollow and containing a semi-permeable fitting, means to bring said sea water in said first chamber into contact with said semi-permeable fitting, and wherein imbalance in salt concentration between said sea water and said fresh water generates a fresh water transfer by osmosis from said second chamber to said first chamber.

* * * * *